US005292003A

United States Patent [19]

Baghdassarian

[11] Patent Number: 5,292,003

[45] Date of Patent: Mar. 8, 1994

[54] COMBINED GIFT BOX AND DISPLAY PACKAGING

[76] Inventor: Ivan D. Baghdassarian, 130 De Languedoc, St Lambert, Quebec, Canada, J4S 1T3

[21] Appl. No.: 128,230

[22] Filed: Sep. 29, 1993

[51] Int. Cl.[5] ..... B65D 71/00

[52] U.S. Cl. ..... 206/575; 206/457; 206/471; 206/469; 229/87.19

[58] Field of Search ..... 206/45.31, 232, 575, 206/457, 471, 469, 467; 229/87.19

[56] References Cited

U.S. PATENT DOCUMENTS

| | | | |
|---|---|---|---|
| 2,073,515 | 4/1936 | Lees . | |
| 2,651,131 | 9/1953 | Long et al. . | |
| 2,862,321 | 12/1958 | James . | |
| 3,441,127 | 4/1969 | Manning . | |
| 3,829,008 | 8/1974 | Murray et al. . | |
| 4,453,629 | 6/1984 | Goldberg | 206/471 X |
| 4,566,592 | 1/1986 | Klukos . | |
| 4,569,442 | 2/1986 | Bushey | 206/469 |
| 4,574,954 | 3/1986 | Reid | 206/471 X |
| 4,584,042 | 4/1986 | Wandroik | 206/575 X |
| 4,726,509 | 2/1988 | Fonas . | |
| 5,004,144 | 4/1991 | Selga | 206/457 X |
| 5,226,532 | 7/1993 | Davidson et al. . | |
| 5,251,759 | 10/1993 | Gannon et al. | 206/575 |

*Primary Examiner*—Paul T. Sewell
*Assistant Examiner*—Jacob K. Ackun, Jr.
*Attorney, Agent, or Firm*—ROBIC

[57] ABSTRACT

The combination of a gift box, a decorative bow and a display packaging for these box and bow. The display packaging has a back panel of greater dimensions than the gift box and a transparent cover for housing and protecting both the box and bow. This cover is made of semi-rigid transparent plastic material and has a protruding hemispherical bubble formed in its front surface so as to house and protect the bow.

7 Claims, 2 Drawing Sheets

COMBINED GIFT BOX AND DISPLAY PACKAGING

BACKGROUND OF THE INVENTION

1. Field of the Invention

The present invention relates to gift boxes and wrapping and more specifically to the combination of a gift box, a decorative bow and a display packaging for the same, which can be offered for sale as such in the retail stores for those who want to nicely "wrap" a gift prior to offering it.

2. Brief Description of the Prior Art

There is a fairly extensive prior art pertaining to the subject of gift boxes. Such boxes are typically made from stiff paperboard or the like, which is foldable either into a flat, envelope-like form, or in the form of a parallelepiped container. Such construction may or may not be designed to be sold within a display packaging.

In U.S. Pat. No. 2,037,515 issued to W. H. LEES on Apr. 14, 1936, there is disclosed gift wrapping package that includes a ribbon card to stiffen it. The package is sold in a substantially flat form.

In U.S. Pat. No. 3,829,008 issued to MURRAY et al on Aug. 13, 1974, there is disclosed a receptacle in the form of a parallelepiped container having foldable wrapping flaps secured to its underside. The wrapping flaps have reverse decorative sides which appear to the sight when they are folded up to wrap the container. The invention disclosed in this patent is limited to the container itself and does not disclose or suggest any display packaging for it.

In U.S. Pat. No. 4,566,592 issued to KLUKOS on Jan. 28, 1986, there is disclosed a packaging for flat, planar objects such as cards and lithographs. This packaging has a ribbon which sandwiches and holds the cards together. It is clearly limited to such planar objects.

In U.S. Pat. No. 4,726,509 issued to FONAS on Feb. 23, 1988, there is disclosed a gift wrapping which is laminated to a box and a system of tabs and slots to attach a decorative bow or rosette thereto.

In U.S. Pat. No. 5,226,532 issued to DAVIDSON et al on: Jul. 13, 1993, there is disclosed a container which is formed of a cutout blank foldable into a rectangular shape. In this patent, the gift must be inserted at one step of the folding operation.

OBJECT AND SUMMARY OF THE INVENTION

The object of the present invention is to provide a kit comprising, in combination, a gift box, a decorative bow, an optional greeting card and a protective yet attractive display packaging for all these elements, which kit can be offered for sale in retail stores to those who want to easily and rapidly wrap a gift they just bought before offering it.

More particularly, the invention as broadly claimed hereinafter, is directed to the combination of a gift box, a decorative bow and a display packaging for said box and bow, said combination comprising:

a) a gift box of a given size and height, said gift box being adapted to receive and contain a gift;

b) a decorative bow adapted to be glued onto said gift box to decorate the same; and c) a display packaging comprising:

a back panel of greater dimensions than said gift box; and a transparent cover for housing and protecting both of said box and said bow, said cover being made of semi-rigid transparent plastic material and a front surface and a set of side walls of such a size and a height as to define a cavity in which the box may be housed;

a protruding hemispherical bubble formed in said front surface, said bubble being of such a size as to house and protect said bow, and a perimetrical flange projecting from said side walls and adapted to be connected to said back panel with said box and bow housed in said transparent cover.

As can be appreciated, the combination according to the invention may be used to sell a simple yet attractive gift box with a matching decorative bow which, thanks their packaging, can advantageously be displayed in a retail store, and which are ready for use when the packaging is removed.

As can also be understood, the gift box, the bow and their associated packaging can be of any size to merit all needs.

BRIEF DESCRIPTION OF THE DRAWINGS

The invention and its numerous advantages will be better understood upon reading of the following non-restrictive description of a preferred embodiment thereof, given with reference to the accompanying drawings, in which.

DESCRIPTION OF A PREFERRED EMBODIMENT

Figure 1:
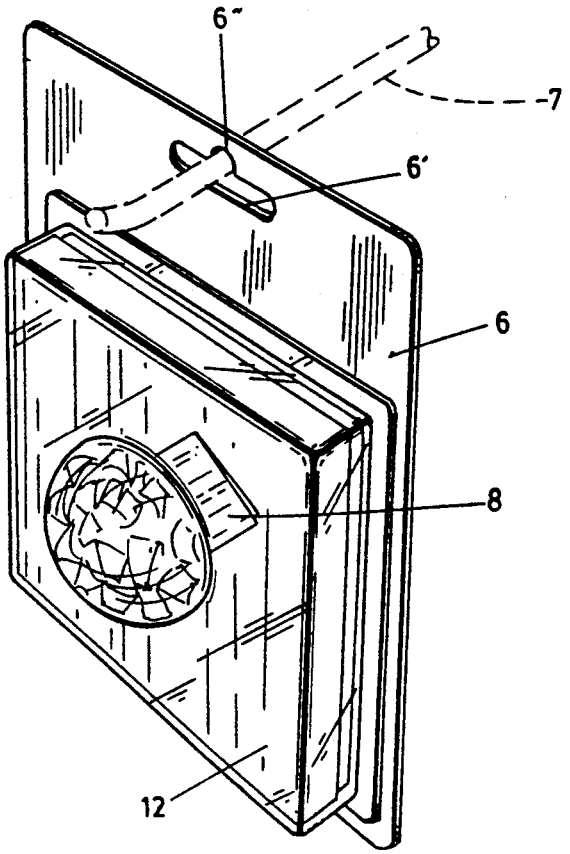
FIG. 1 is a perspective view of a preferred embodiment of the invention, showing it fixed to a display hanger shown in dashed outline.

The gift box and packaging combination or "kit" shown in the accompanying drawings basically comprises a gift box 1 that may be of any size or shape, even though only a square shape has been shown in the figures. Preferably, the container 1 is provided with cotton padding material 1' to enhance the appearance of a gift (not shown) placed therein, as well as to provide a cushion for this gift. The container 1 is formed of a bottom 2 and four sides 2'. The gift box also includes a matching lid 4 for use to close the container. Both the container 1 and its lid 4 are decorated externally to be attractive. Preferably, such a decoration is achieved by laminating onto their respective outer surfaces decorative wrapping paper 3 and 5, respectively.

Figure 2:
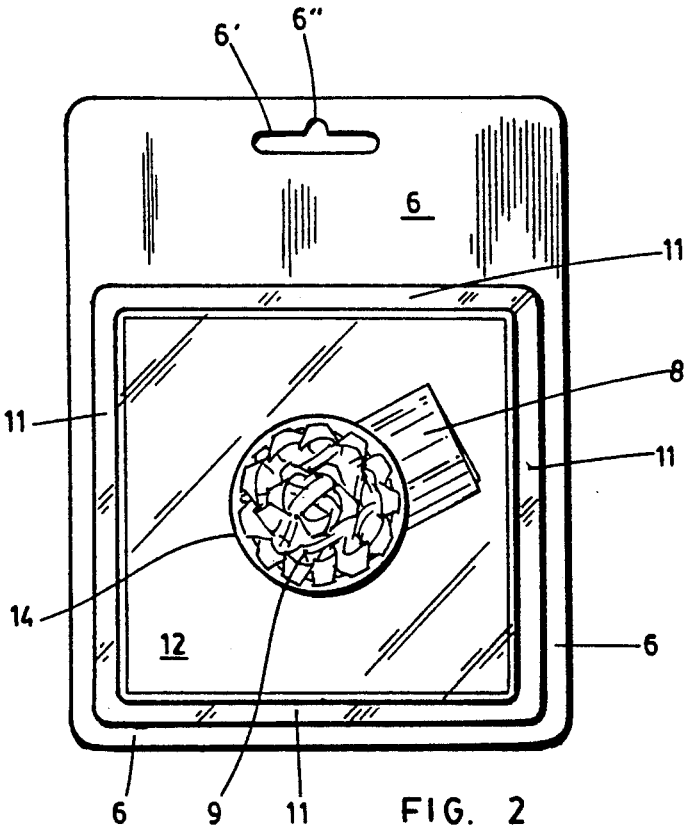
FIG. 2 is a front elevation view of the gift box and packaging combination of FIG. 1.
Figure 3:
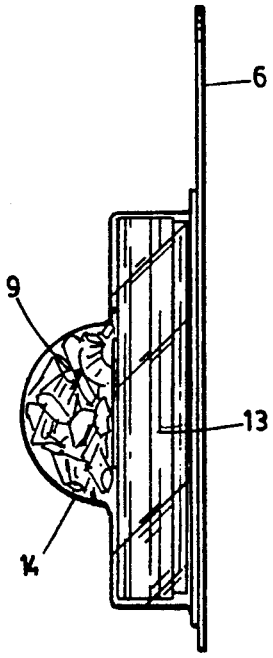
FIG. 3 is a side view of the gift box and packaging combination of FIG. 1.
Figure 4:
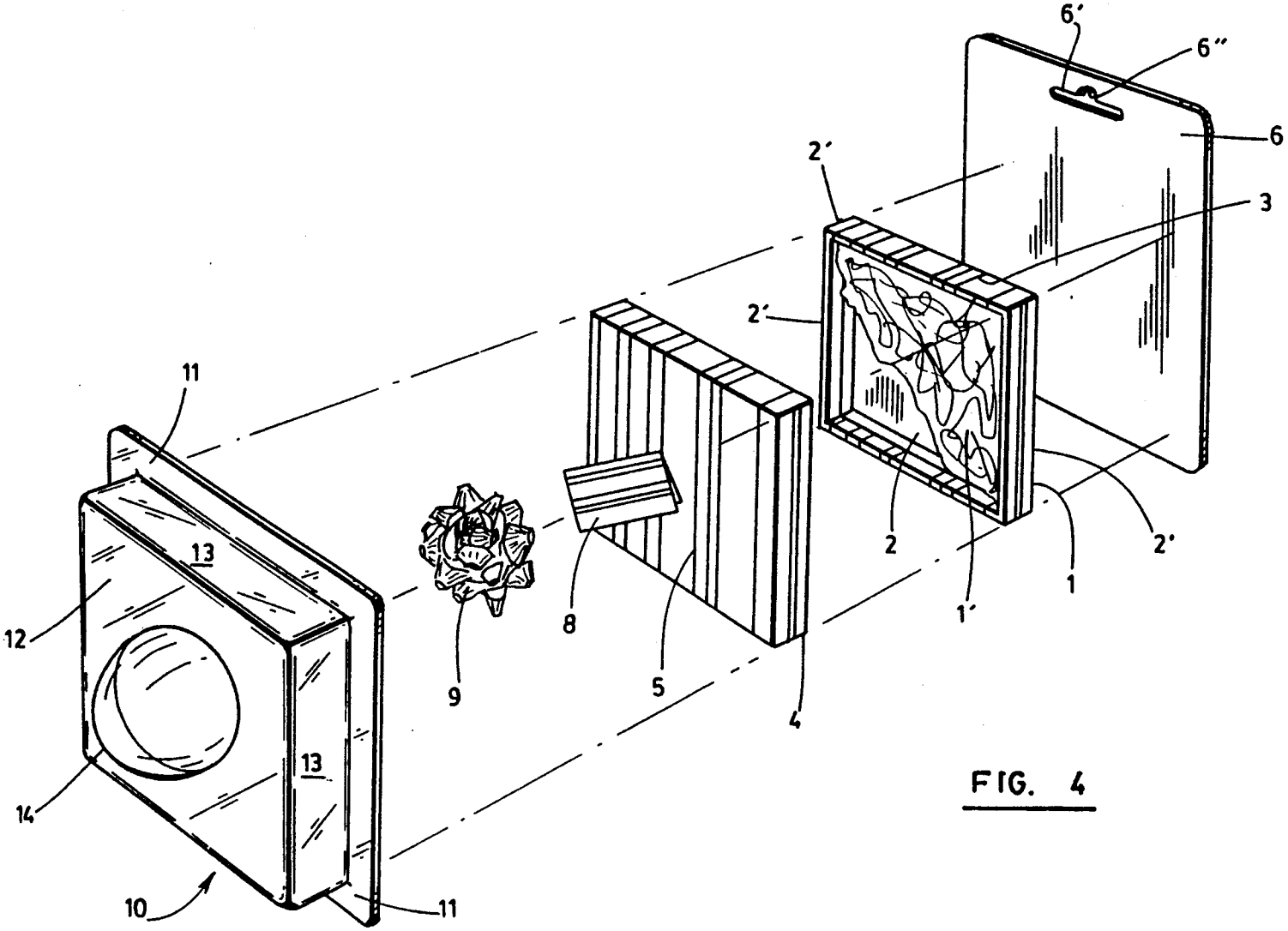
FIG. 4 is an exploded perspective view of all the constituting elements of the combination shown in FIGS. 1 to 3.

The gift and packaging combination according to the invention also comprises a decorative bow or rosette 9. The bow 9 is preferably of appreciatively approximately hemispherical shape and provided with a peelable adhesive bottom surface for use to attach it to the lid 4. The bow 9 whose color is preferably selected to match the one of the box, may also serve to retain a greeting card 8, as clearly shown in FIG. 2, which is preferably decorated with the same pattern as the container and lid.

The combination further comprises a packaging for the gift box, the bow 9 and the card 8. This packaging comprises a back panel 6 which is made of thin cardboard and is of slightly greater dimensions than the container 1 on three sides and significantly longer on the fourth side. The after is provided with attachment means to hang the packaged gift box on a display rack or the like in a store. These attachment means preferably consist of an opening in the form of a slit 6' and of a rounded notch 6" adapted to receive a rod 7 forming part of the display rack. Of course, the back panel can be printed on both sides with any requested advertising, information and directions for use.

The packaging also comprises a transparent plastic cover 10. The cover 19 has a front surface 12 and a set of side walls of such a size and height to define a cavity in which the gift box may be snugly housed. The cover 10 also has a central protruding hemispherical bubble 14 sized to house and protect the bow 9. The cover 10 further has a perimetral flange 11 integrally projecting from the base of its side walls 13. This flange is sized and adapted to be connected to the panel 6 by gluing or heat-sealing after the box, bow and card have been properly inserted therein. In the illustrated embodiment, such a sealing is made adjacent the edges of the panel on three of its sides and close to the box on its fourth side, where the slit 6' and rounded notch 6" are made.

What is claimed is:

1. The combination of a gift box, a decorative bow and a display packaging for said box and bow, said combination comprising:

a) a gift box of a given size and height, said gift box being adapted to receive and contain a gift;

b) a decorative bow adapted to be glued onto said gift box to decorate the same; and c) a display packaging comprising:

a back panel of greater dimensions than said gift box; and a transparent cover for housing and protecting both of said box and said bow, said cover being made of semi-rigid transparent plastic material and a front surface and a set of side walls of such a size and a height as to define a cavity in which the box may be housed;

a protruding hemispherical bubble formed in said front surface, said bubble being of such a size as to house and protect said bow, and a perimetrical flange projecting from said side walls and adapted to be connected to said back panel with said box and bow housed in said transparent cover.

2. The combination of claim 1, further comprising:

d) a greeting card housed in said transparent cover together with said box.

3. The combination of claim 2, wherein said gift box comprises an open container closed by a lid.

4. The combination of claim 3, wherein said open container and lid are made of stiff paperboard and are externally laminated with a decorative wrapping paper.

5. The combination of claim 4, wherein said open container includes a cotton padding.

6. The combination of claim 5, wherein said back panel is printed and comprises a central opening on top of it, away from said transparent cover, to hang said combination to a store display unit.

7. The combination of claim 3, wherein said back panel is printed and comprises a central opening on top of it, away from said transparent cover, to hang said combination to a store display unit.

* * * * *